US005265147A

United States Patent [19]

Kim et al.

[11] Patent Number: 5,265,147

[45] Date of Patent: Nov. 23, 1993

[54] X-RAY TUBE NOISE REDUCTION USING STATOR MASS

[75] Inventors: Jeung T. Kim, Daejon, Rep. of Korea; Richard H. Lyon, Belmont, Mass.; Imdad Imam, Schenectady, N.Y.

[73] Assignee: General Electric Company, Schenectady, N.Y.

[21] Appl. No.: 891,023

[22] Filed: Jun. 1, 1992

[51] Int. Cl.[5] ..... H01J 35/10

[52] U.S. Cl. ..... 378/131; 378/132; 378/123

[58] Field of Search ..... 378/123, 131, 132, 133, 378/141, 142, 127

[56] References Cited

U.S. PATENT DOCUMENTS

| | | | |
|---|---|---|---|
| 4,622,687 | 11/1986 | Whitaker et al. | 378/130 |
| 4,920,554 | 4/1990 | Gabbay et al. | 378/200 |
| 4,935,948 | 6/1990 | Kim | 378/125 |

*Primary Examiner*—David P. Porta
*Assistant Examiner*—D. Wong
*Attorney, Agent, or Firm*—Patrick R. Scanlon; Paul R. Webb, II

[57] ABSTRACT

X-ray tube noise is reduced by coupling the stator mass to the neck section of the glass vacuum tube so that vibrations are dissipated by the stator and not transmitted to the bulk of the vacuum tube. The coupling is accomplished with a non-magnetic sealing material such as an epoxy sealant. The sealant will generally fill the gap between the stator and the neck section of the vacuum tube. Alternatively, the coupling can be done with a mechanical clamping device.

20 Claims, 4 Drawing Sheets

X-RAY TUBE NOISE REDUCTION USING STATOR MASS

CROSS REFERENCES TO RELATED APPLICATIONS

This application is related to copending application entitled "X-ray Tube Noise Reduction Using an Oil Substitute", Ser. No. U.S. patent Ser. No. 07/891008, Feb. 5, 1993, and copending application entitled "X-ray Tube Noise Reduction Using Non-Glass Inserts", Ser. No. U.S. patent Ser. No. 07/891007, Jun. 1, 1992, both filed concurrently herewith and assigned to the same assignee as the present invention.

BACKGROUND OF THE INVENTION

This invention relates generally to X-ray tubes and more particularly concerns utilizing the mass of an X-ray tube's stator to reduce noise produced by the X-ray tube.

The use of X-ray tubes for medical diagnostics is quite common. Unfortunately, an X-ray tube operating at a steady state condition generates significant levels of high frequency noise. The sound pressure may vary from one X-ray tube design to another, but is often in the range of 65–75 decibels and is sometimes even higher. This is typically 10–20 dB higher than the background noise level in a common medical environment. Thus, X-ray tube noise is a problem because the current noise levels are not only a general annoyance to patients, doctors and medical personnel but also make patient-doctor communications difficult.

A conventional X-ray tube comprises a vacuum tube mounted within an outer casing. The remaining interior space of the casing is filled with oil. The oil dissipates heat generated in the vacuum tube and serves as a dielectric or electrical insulator. The vacuum tube includes a target which is bombarded with electrons emitted from an electron emitter. The electrons cause the target to emit X-ray radiation. In order to prevent its rapid deterioration, the target is rotated at approximately 10,000 RPM. To accomplish this rotation, the target is mounted to a rotatable shaft which is coupled to the vacuum tube via bearings. The rotation of the target generates vibration which is transmitted through the bearings to the vacuum tube. Since the casing oil is essentially incompressible, the vibration is readily transmitted from the vacuum tube to the outer casing with little attenuation. When the vibration energy is received by the casing, the casing radiates sound to the ambient. The casing is very thick and has a non-uniform spatial distribution so that the chances to reduce sound radiation from the casing are very limited. Although the vibration energy transmitted to the casing could be reduced by lowering the rotational speed of the target, this would severely shorten the life expectancy of the target unless the X-ray power was lowered in accordance with the lowered rotational speed. However, lowering the X-ray power would sacrifice the quality of the image.

One means for reducing X-ray tube noise without shortening target life expectancy or sacrificing image quality is described in U.S. Pat. No. 4,935,948, issued Jun. 19, 1990 to Jeung T. Kim. U.S. Pat. No. 4,935,948 discloses attaching a ring mass on or near the bearing shroud which physically connects the rotor bearings to the vacuum tube. The ring mass dissipates the vibrational energy which would otherwise be transmitted from the rotor bearing to the vacuum tube and on to the casing. Thus, the addition of the ring mass reduces the total noise produced by the X-ray tube. The use of a ring mass, which weighs about two pounds or more, significantly increases the overall weight of the X-ray tube. Furthermore, if made of an electrically conductive material, the ring mass creates an electrical flashover problem because it is located near the very high voltage region within the X-ray tube.

SUMMARY OF THE INVENTION

Accordingly, it is an object of the present invention to provide a means for reducing noise in an X-ray tube.

More specifically, it is an object of the present invention to reduce X-ray tube noise by joining the stator to the neck of the glass vacuum tube.

In addition, it is an object of the present invention to provide a means for reducing noise in an X-ray tube which does not significantly increase the weight of the X-ray tube.

It is another object of the present invention to provide a means for reducing noise in an X-ray tube which does not create electrical flashover.

It is yet another object of the present invention to provide a means for reducing noise in an X-ray tube which can be directly implemented to a conventional X-ray tube with very little design modification.

These and other objects are accomplished in the present invention by providing a means for coupling the stator of an X-ray tube to the neck section of the glass vacuum tube so that vibrations are dissipated by the stator and not transmitted to the bulk of the vacuum tube. The means for coupling can comprise a non-magnetic sealing material such as an epoxy sealant. The sealant will generally fill the gap between the stator and the neck section of the vacuum tube. Alternatively, the means for coupling can be a mechanical clamping device.

Other objects and advantages of the present invention will become apparent upon reading the following detailed description and the appended claims and upon reference to the accompanying drawings.

DESCRIPTION OF THE DRAWINGS

The subject matter which is regarded as the invention is particularly pointed out and distinctly claimed in the concluding portion of the specification. The invention, however, may be best understood by reference to the following description taken in conjunction with the accompanying drawing figures in which:

DETAILED DESCRIPTION OF THE INVENTION

Figure 1:
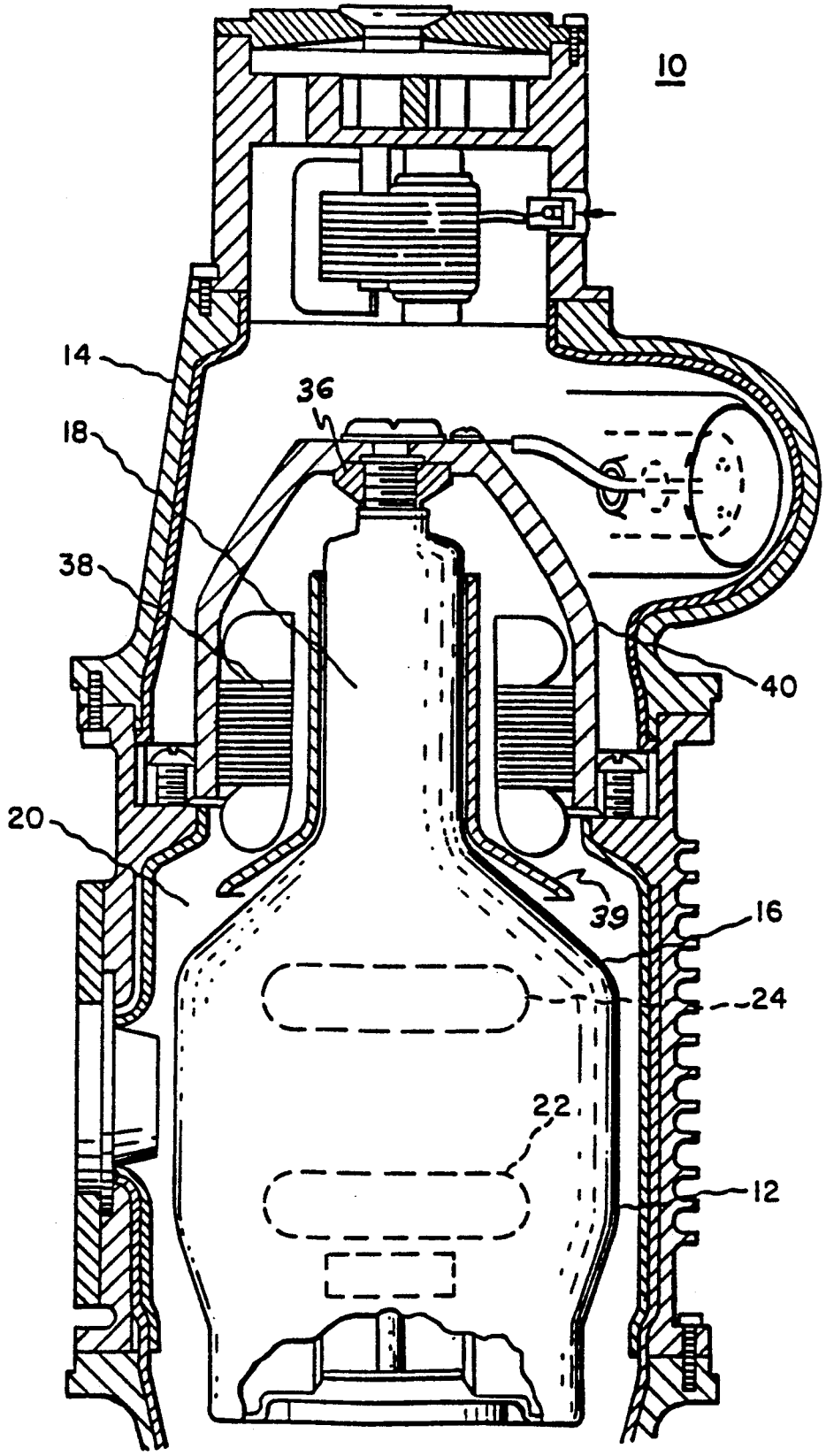
fig. 1 (PRIOR ART)
FIG. 1 shows a simplified side view cross-section of a conventional X-ray tube with some parts shown schematically.
Figure 2:
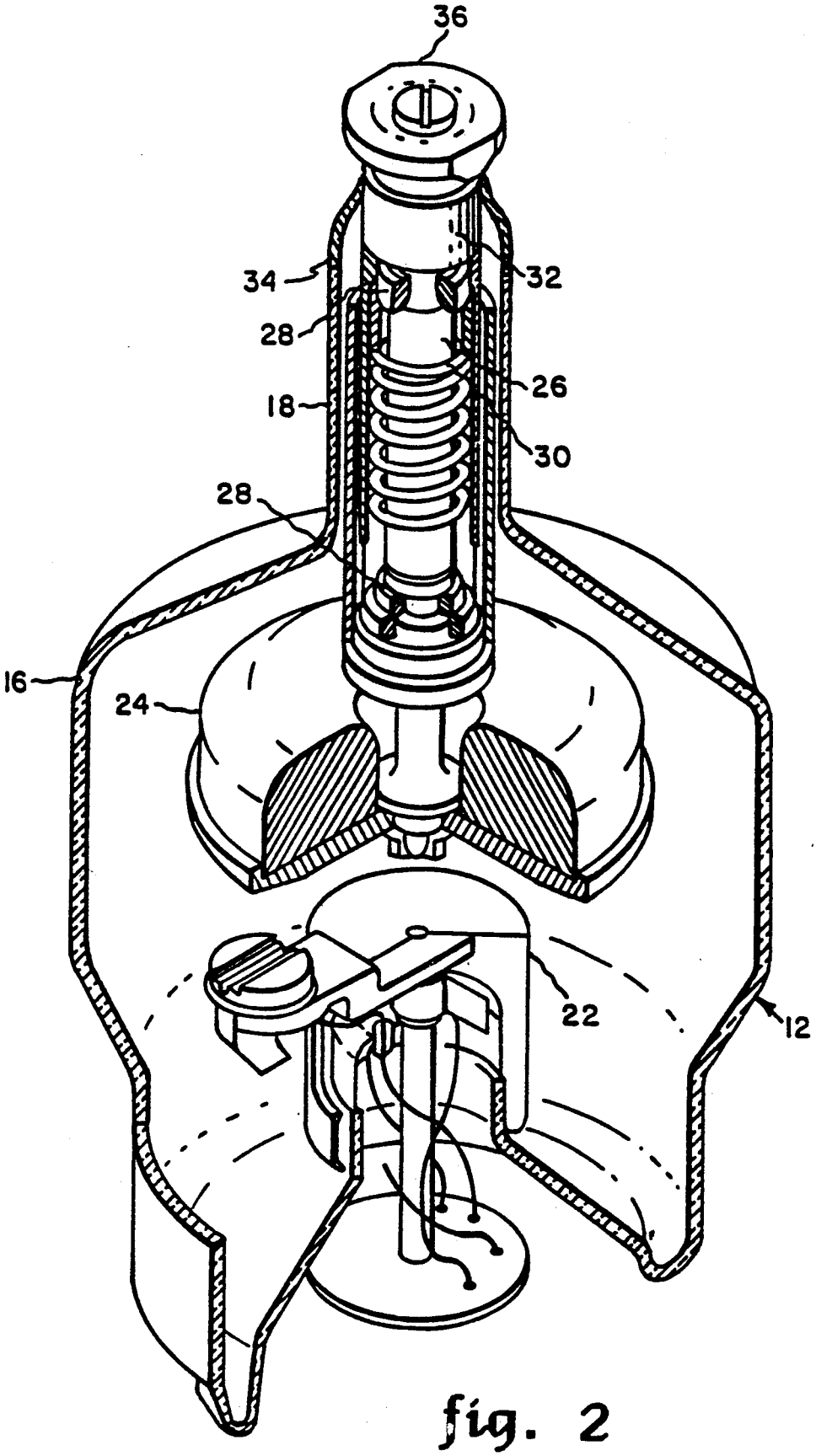
fig. 2 (PRIOR ART)
FIG. 2 shows a partially cut away perspective view of the vacuum tube of a conventional X-ray tube.

With reference to FIGS. 1 and 2, a conventional X-ray tube 10 having a vacuum tube 12 disposed within a casing 14 is shown. For ease of illustration, FIG. 2 shows the vacuum tube 12 removed from the casing. The vacuum tube 12 is a unitary member comprising a relatively large glass envelope or bell 16 and a narrow glass neck 18 joined together by a tapering junction section. The glass neck 18 extends outwardly from one end of the envelope 16. A chamber 20 between the vacuum tube 12 and the casing 14 is filled with an oil which provides cooling and dielectric functions.

Inside of the vacuum tube 12 is an electron emitter 22 and a target 24, both of which are shown schematically in FIG. 1. The electron emitter 22 emits electrons which strike the target 24 in order to generate X-ray energy in a known fashion.

Concentrating on the view of FIG. 2, the target 24 is mounted to a rotor 26 for rotation therewith. The rotor 26 has ball bearing assemblies 28 mounted at opposite ends thereof. A spring 30 is disposed between the ball bearings 28 and a rotor base 32 is disposed at one end of the rotor 26. A bearing shroud or interface member 34 extends from the distal end of the glass neck 18 to the rotor base 32, thereby connecting these elements. The interface member is a thin sleeve which is somewhat conical in shape and is generally made of an alloy material such as that which is commercially available under the trademark Kovar. This interface member 34 has thermal characteristics which reduce the chances that the diverse thermal characteristics of the base 32 and the glass neck 18 will cause cracking of the neck. A connecting piece 36 is disposed adjacent to the rotor base 32.

Referring again to FIG. 1, a stator member 38 is disposed around the glass neck 18 and serves to turn the rotor 26 (not shown in FIG. 1), thereby rotating the target 24. The stator 38 is spaced from the neck 18 to define a gap therebetween. A stator shield 39 is disposed in the gap between the stator 38 and the glass neck 18 in a spaced relationship from both the stator and the neck. The stator 38 is enclosed within a basket 40 which generally surrounds the neck 18. The vacuum tube is attached to the basket 40, and thus the casing 14, via the connecting piece 36.

It should be noted that the primary noise source of the X-ray tube is the bearing vibration resulting from the rotation of the rotor 26 and the associated components. The bearing vibration travels along a primary energy transmission path or circuit in which vibration is transmitted through the interface member 34 to the glass neck 18 which is strongly coupled to the interface member 34. If not repressed, the vibration will be transmitted from the neck 18 to the glass envelope 16. Because of its relatively large size, the envelope 16 is the primary source of further vibration transmission. Particularly, the vibration is readily transmitted from the glass envelope 16 to the casing 14 with little attenuation by the oil filling the chamber 20. The casing 14 converts the vibration to sound energy which is radiated to the ambient.

Figure 3:
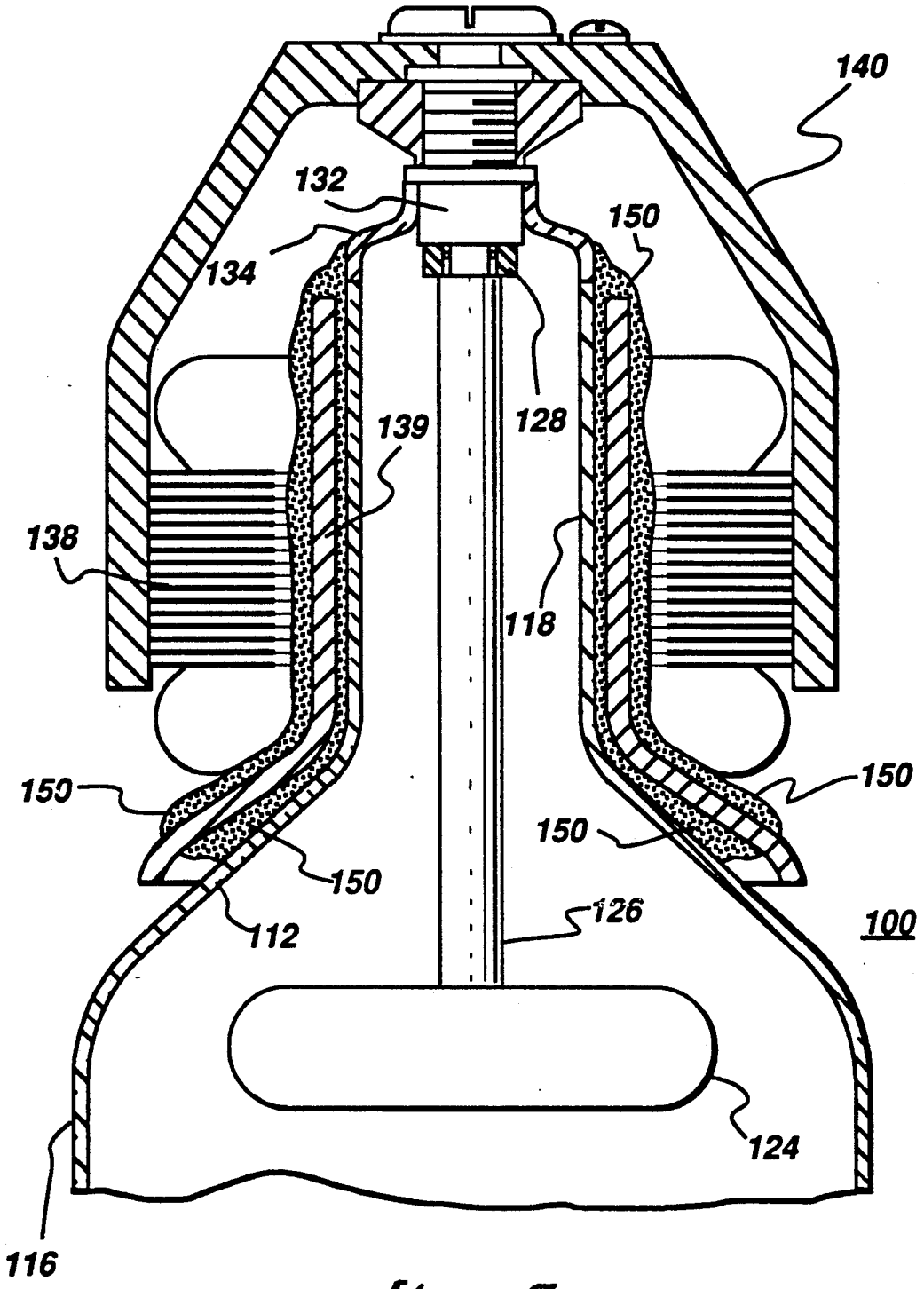
FIG. 3 shows a partial side view cross-section of the X-ray tube of the present invention.

Turning now to FIG. 3, the arrangement of the present invention which is used to reduce X-ray tube noise will be described. FIG. 3 shows a partial cross-section of an X-ray tube 100. Except for the modification described below, the X-ray tube 100 is structurally similar to the conventional X-ray tube of FIGS. 1 and 2. Particularly, the X-ray tube 100 comprises a unitary vacuum tube 112 disposed within a casing (not shown in FIG. 3). The vacuum tube 112 comprises a glass envelope 116 and a glass neck 118 extending outwardly from one end of the envelope and joined thereto by a tapering junction section. A target 124 and a rotor 126, both shown schematically in FIG. 3, are disposed in the vacuum tube 112. The rotor 126 is rotatively supported by ball bearing assemblies 128 mounted at opposite ends thereof (only one shown in FIG. 3). A rotor base 132 is disposed at one end of the rotor 126. A bearing shroud or interface member 134 connects the end of the glass neck 118 to the rotor base 132. A stator member 138 for turning the rotor 126 encircles the neck 118 and is spaced from the neck 118 to define a gap therebetween. A stator shield 139 is disposed in the gap between the stator 138 and the neck 118 in a spaced relationship from both the stator and the neck. The stator 138 is supported by a basket 140 which generally encloses the stator 138, the stator shield 139 and the neck 118.

The elements of the X-ray tube 100 which are described above are essentially the same structure found in a conventional X-ray tube. Since these elements operate in a known fashion to generate X-ray radiation, they need not be described in further detail for a full understanding of the present invention.

Figure 3A:
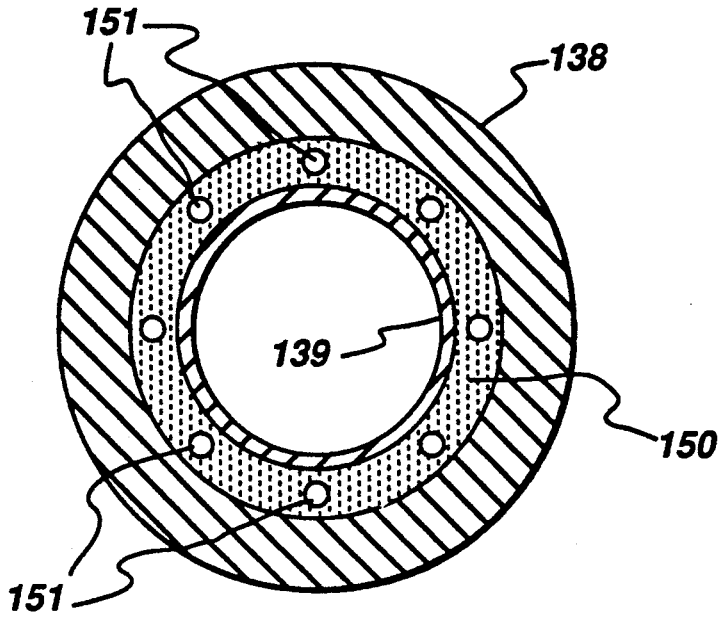
FIG. 3A shows a partial end view cross-section of the X-ray tube of FIG. 3.

The present invention accomplishes noise reduction by filling both the gap between the neck 118 and the stator shield 139 and the gap between the stator shield 139 and the stator 138 with a sealing material 150. The stator 138 is thus tightly coupled to the glass neck 118, effectively adding the mass of the stator 138 to the neck 118. The stator mass, which is about 1.8 Kg, is heavy enough to attenuate high frequency vibration energy. The sealing material 50 must provide enough strength to sufficiently tighten the stator 138 over the neck 118 and should be a non-magnetic material so as not to interfere with the magnetic flux produced by the stator. Most non-magnetic adhesives are adequate for this purpose, with epoxy sealants being preferred. As seen in FIG. 3A, a plurality of hollow tubes 151 are arranged circumferentially around the stator shield 139 and extend longitudinally through the sealing material 150. The tubes 151, which are made of a heat conducting material, allow the casing oil to pass therethrough, thereby cooling the affected region of the X-ray tube.

As an alternative to a sealing material, the stator 138 can be coupled to the glass neck 118 by means of a mechanical clamping device. Generally, any known clamping device suitable for clamping the stator to the glass neck can be used. The use of a clamping device has an advantage in that it would not block the casing oil from the region, thereby negating the need for the tubes 151.

Coupling the mass of the stator 138 to the neck 118 reduces X-ray tube noise because the stator mass is believed to act as a ground in the energy transmission circuit. That is, a large portion of the vibration energy received by the neck 118 is dissipated by the stator 138 and only a small fraction of the received vibration is transmitted to the larger envelope 116. The vibration amplitude in the envelope 116 is thus greatly lessened resulting in an attenuation of the sound level generated by the casing of the X-ray tube. A more detailed discussion of the theoretical principles explaining why attaching a weight to the neck portion of the vacuum tube dissipates incoming vibration energy is given in the above-mentioned U.S. Pat. No. 4,935,948, which is hereby incorporated by reference.

Figure 4:
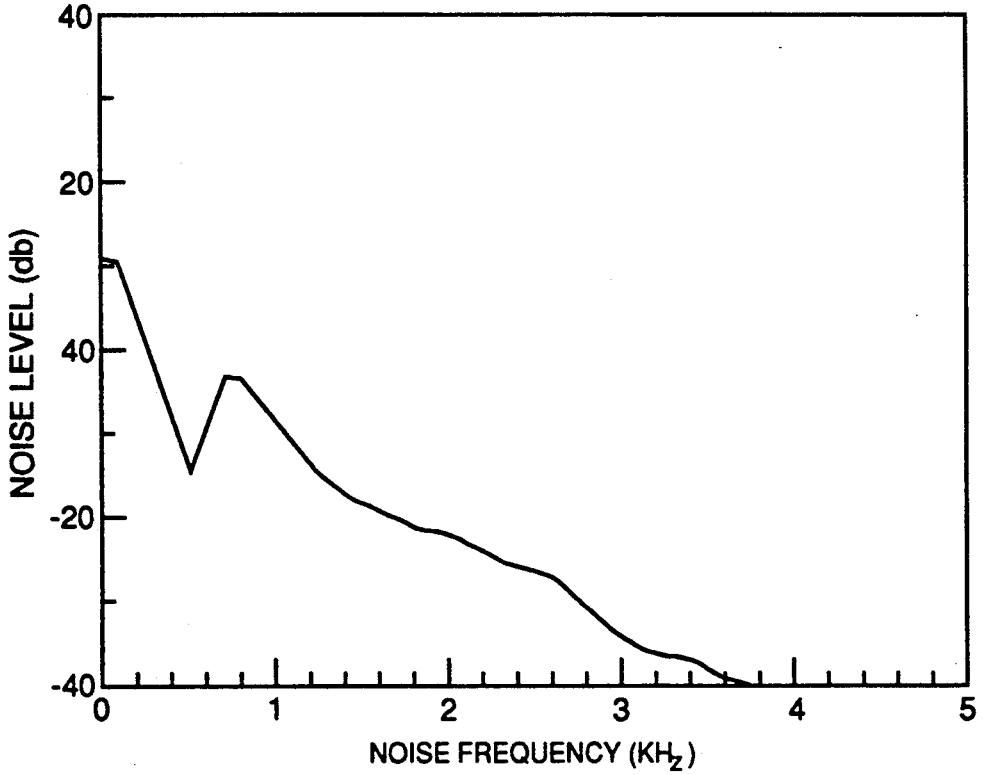
FIG. 4 shows a graph plotting the amount of noise reduction provided by the present invention against noise frequency.

FIG. 4 shows a theoretical prediction of the noise reduction achieved by employing the present invention. Specifically, FIG. 4 shows a graph plotting noise reduction in decibels against noise frequency in kilohertz. As can be seen from the Figure, noise is actually amplified at very low frequencies, but significant noise reduction is achieved at frequencies above 1 kilohertz. Although the theoretical noise reduction is strong as frequency increases, the actual reduction possible, while being quite good, is not as impressive. This is because if the vibration level in the vacuum tube becomes lower than that in the stator, then the primary vibration transmission path will change from interface member-vacuum tube-oil-casing to interface member-stator-casing.

The concept of the present invention has been tested on actual X-ray tubes. An experiment was conducted comparing a conventional X-ray tube and an X-ray tube having an epoxied stator in the manner of the present invention. Both devices were operated under the same conditions. Vibration at the end of the vacuum tube and the sound level at a distance of 1 meter from the casing were both measured. The overall sound level in A-weighting for the conventional X-ray tube was 66.9 dB, while for the modified X-ray tube the sound level was 57.4 dB. This is a noise reduction of 9.5 dB or about 14%. Similarly, the vibration level of 10.9 $m/sec^2$ for the conventional device was reduced to 3.36 $m/sec^2$ in the device implementing the present invention.

Various ancillary noise reduction means are available to supplement the noise reduction provided by coupling the stator mass to the vacuum tube. For instance, the casings of conventional X-ray tubes usually include a lead lining as an X-ray shield. The lead lining and casing wall have similar impedance characteristics so vibration is easily transmitted. Disposing a soft foam substance between the lead lining and the casing wall creates an impedance mismatch and hinders further transmission of any vibration energy not dissipated by the stator mass. The foam is provided in the regions immediately surrounding the large envelope portion of the vacuum tube. These locations are the most sensitive to vibration energy transmitted from the vacuum tube. Another ancillary means of noise reduction is to replace the typical ball bearings with needle bearings. The needles are cylindrical members which have a large length-to-diameter ratio so that contact pressure is reduced and rolling friction is low. Due to the extended length of the needles, a needle bearing is less sensitive to the centrifugal force created by the heavy target rotating at a high speed. Thus, the needle bearing can generally reduce the amount of bearing vibration initially generated.

The foregoing has described a means for reducing noise in X-ray tubes that does not increase the overall weight of the system or require design modifications and maintains a high quality X-ray image.

While specific embodiments of the present invention have been described, it will be apparent to those skilled in the art that various modifications thereto can be made without departing from the spirit and scope of the invention as defined in the appended claims.

What is claimed is:

1. An X-ray tube comprising:

a vacuum tube;

a stator disposed around at least a portion of said vacuum tube; and means for coupling said stator to said vacuum tube so that vibrations are dissipated by said stator.

2. The X-ray tube of claim 1 wherein said means for coupling comprises a sealing material joining said stator and said vacuum tube.

3. The X-ray tube of claim 2 wherein said sealing material is a non-magnetic sealing material.

4. The X-ray tube of claim 2 wherein said sealing material is an epoxy sealant.

5. The X-ray tube of claim 2 further comprising a plurality of cooling tubes extending through said sealing material.

6. The X-ray tube of claim 1 wherein said stator weighs approximately 1.8 Kg.

7. An X-ray tube comprising:

a vacuum tube comprising an envelope section and a neck section extending from said envelope section;

a stator disposed around said neck section, said stator being spaced from said neck section so as to form a gap therebetween; and means for coupling said stator to said neck section so that vibrations are dissipated by said stator.

8. The X-ray tube of claim 7 wherein said means for coupling comprises a sealing material filling said gap.

9. The X-ray tube of claim 8 wherein said sealing material is a non-magnetic sealing material.

10. The X-ray tube of claim 8 wherein said sealing material is an epoxy sealant.

11. The X-ray tube of claim 8 further comprising a plurality of cooling tubes extending through said sealing material.

12. The X-ray tube of claim 7 further comprising a stator shield disposed in said gap in a spaced relationship from both said stator and said neck section, said means for coupling comprising a sealing material filling the space between said stator and said stator shield and the space between said neck section and said stator shield.

13. The X-ray tube of claim 7 wherein said stator weighs approximately 1.8 Kg.

14. An X-ray tube comprising:

a vacuum tube comprising an envelope section and a neck section extending from said envelope section;

a stator disposed around said neck section, said stator being spaced from said neck section so as to form a gap therebetween;

a rotor assembly disposed within said vacuum tube, said rotor assembly comprising a rotor shaft and at least one bearing for rotatively supporting said shaft;

an interface member connecting said rotor assembly to said neck portion; and means for coupling said stator to said neck portion so that vibrations from said rotor assembly are dissipated by said stator and not transmitted to said envelope section.

15. The X-ray tube of claim 14 wherein said means for coupling comprises a sealing material filling said gap.

16. The X-ray tube of claim 15 wherein said sealing material is a non-magnetic sealing material.

17. The X-ray tube of claim 15 wherein said sealing material is an epoxy sealant.

18. The X-ray tube of claim 15 further comprising a plurality of cooling tubes extending through said sealing material.

19. The X-ray tube of claim 14 further comprising a stator shield disposed in said gap in a spaced relationship from both said stator and said neck section, said means for coupling comprising a sealing material filling the space between said stator and said stator shield and the space between said neck section and said stator shield.

20. The X-ray tube of claim 14 wherein said stator weighs approximately 1.8 Kg.

* * * * *